US006645014B2

(12) United States Patent
Lin

(10) Patent No.: US 6,645,014 B2
(45) **Date of Patent: *Nov. 11, 2003**

(54) HINGED WIRING BLOCK

(75) Inventor: Mike H. Lin, Cerritos, CA (US)

(73) Assignee: International Connectors & Cable Corporation, Cerritos, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/965,144

(22) Filed: Sep. 26, 2001

(65) Prior Publication Data

US 2002/0019151 A1 Feb. 14, 2002

Related U.S. Application Data

(63) Continuation of application No. 09/197,016, filed on Nov. 20, 1998.

(51) Int. Cl.[7] ..... H01R 9/22
(52) U.S. Cl. ..... 439/713
(58) Field of Search ..... 439/403–404, 439/713, 532, 709, 715, 716, 419, 152, 296, 631, 540.1, 541.5; 174/60

(56) References Cited

U.S. PATENT DOCUMENTS 3,784,728 A * 1/1974 De Bortoli et al. ..... 361/823
3,798,587 A * 3/1974 Ellis, Jr. et al. ..... 439/404

* cited by examiner

*Primary Examiner*—Jean F. Duverne
(74) *Attorney, Agent, or Firm*—Christie, Parker & Hale, LLP

(57) ABSTRACT

A wiring block mountable to a support surface for terminating communication wires includes a base having a mounting portion and first and second support members extending outwardly from the mounting portion. The first and second supports are spaced apart to form a cabling channel therebetween for receiving communication wires. A termination strip having a row of spaced apart teeth defining a plurality of slots for receiving communication wires is mounted to the base. The termination strip has a first end that is removably attached to the first support member and a second end that is hingedly connected to the second support member.

10 Claims, 11 Drawing Sheets

HINGED WIRING BLOCK

CROSS REFERENCE TO RELATED APPLICATIONS

This application is a continuation of allowed application Ser. No. 09/197,016, filed Nov. 20, 1998, the disclosures of which are incorporated fully herein by reference.

This invention relates generally to wiring blocks and wiring block systems for use primarily in the communications industry. In particular, the invention relates to a hinged wiring block and to systems using a hinged wiring block.

BACKGROUND OF THE INVENTION

Wiring blocks are designed to support voice and high speed data applications. They serve as the backbone for interconnecting national or international communication networks to the communication network of a particular business or other enterprise having a sufficient amount of telephone, data processing, and data transmitting lines to necessitate careful cable routing and identification. Wiring blocks also facilitate high density cable routing between the outside world and office complexes.

One well known wiring block is the 110A type wiring block from AT&T Technologies. The 110A type wiring block includes a base having integrally molded legs at each end thereof. The legs provide a space behind the wiring block (when mounted) for cables that are to be terminated on the wiring block. Further, each leg terminates at a respective foot, with each foot having a plurality of mounting holes therethrough. A wiring strip for receiving communication wires is secured to the base. The legs extend upwardly past the base and terminate at platforms. Opposing surfaces of each outer pair of the legs include a retaining edge for resiliently securing designation strips.

The 110A type wiring block suffers from several disadvantages and problems, the most significant of which is that the legs are permanently attached thereto and often obstruct wire/cable management during installations, moves and changes. In particular, any post-installation repairs require this type of wiring block to be removed from the surface to which it is attached, which is extremely difficult if not impossible at times. For example, rerouting of wires cannot be performed effectively because the wiring block (and the already connected wires) obstructs the cabling passage between the wiring strip and the wall. Temporary removal of the wiring block from the wall is also not advised because the connected wires make it very difficult to return the wiring block to its original location, especially without adding strain to the connected wires or pulling them loose.

Another type of wiring block is AT&T Technologies 110T type wiring block which does not have integrally molded legs, but is provided with a bracket having legs that may be removably attached to the base. The 110T type wiring block suffers from many of the same disadvantages as the 110A type wiring block. For example, the bracket of the 110T type wiring block must be attached prior to wiring the block. Accordingly, this bracket also obstructs wire/cable management during installations, moves and changes, including post-installation changes.

Yet another type of wiring block is described in U.S. Pat. No. Re. 35,030. This wiring block includes a base having at least one wiring strip snap lock mounted thereto and having a leg assembly snap lock mounted at each end of the base. The leg assemblies provide a space behind the wiring block (when mounted) for cables/wires that are to be terminated at the wiring block. The leg assemblies, however, must be fully assembled to the base to properly position and install the wiring block to a mounting surface. Then, the base must be disassembled from each leg to permit cable routing, adding to the installation time. In addition, termination of communication wires to the wiring strip is difficult to accomplish when the component parts are assembled. Alternatively, if the base is detached, the unsupported part must be handled while terminating the wires, making the task more difficult. Post-installation changes are also difficult. Although the wired base can be detached from the legs, it must either be held in one hand while servicing is performed or the base must be permitted to hang free, but with the risk that the wired connections may become strained or even pulled loose.

In view of the above, it should be appreciated that there is still a need for a wiring block that may be installed prior to routing the cable, yet permits easy access to the cabling channel to facilitate easy termination of the communication wires and easy post-installation repairs.

SUMMARY OF THE INVENTION

The present invention is embodied in a hinged wiring block that may be installed prior to routing communication cables, yet permits easy access to the cabling channel to facilitate easy termination of the wires of the communication cables and easy post-installation repairs.

The wiring block of the present invention includes a base and a termination strip. The base includes a mounting portion, and first and second support members extending outwardly from the mounting portion. Preferably, the first and second support members are spaced apart to form a cabling channel therebetween for receiving cables of communication wires. The termination strip includes a row of spaced apart teeth defining a plurality of slots for receiving the communication wires.

A feature of the wiring block of the present invention is that the termination strip has a first end that is removably attached to the first support member and a second end that is hingedly connected to the second support member such that the termination strip is movable between a closed position wherein the first end of the termination strip is attached to the first support member closing off the cabling channel and an open position wherein the first end of the termination strip is detached and pivoted away from the first support member to form an opening therebetween to permit insertion and removal of communication wires through the opening between the first end of the termination strip and the first support member into and out of the cabling channel.

An advantage of the pivoting feature is that the termination strip remains attached to the base while still allowing it to swing open and closed, permitting easy, hands-free, access by the user. When the termination strip is swung open, the user is allowed to work on the cables after the wiring block is mounted to a surface and even after the cables are already routed and in place. Since the termination strip remains mounted to the base, both of the user's hands remain free for post-installation repairs. In addition, the risk of wire disconnection is reduced since the termination strip does not hang loosely. The hinged design not only saves considerable time, but greatly reduces the work necessary to correct certain installation mistakes. The hinged design also allows the wiring block to be positioned and installed before the cable is routed. This allows the user to have total access to the cabling channel even after the hinged block is mounted onto a surface.

Another feature of the present invention is that the first mounting portion and the second mounting portion may be formed from a single base plate to provide greater structural integrity. In addition, the base plate may be provided with access holes or knockouts to permit cables to be inserted and routed through the base.

Another feature of the present invention is that the termination strip includes a latch for holding it firmly to the base. This prevents the termination strip from swinging open. As a result, the termination strip and base are securely positioned and fastened together on the hinged side, yet easily opened and closed with the latch on the other side.

A further feature of the present invention is that the hinge includes a stop mechanism that automatically stops the termination strip at an intermediate position between its closed and open positions. This provides the user with easy access to the wires and cables without independently handling the termination strip. The locked position also prevents damage to adjacent equipment when the wiring block is swung open. The user also has the option to open the wiring block completely so that the termination strip lays flat adjacent to the base when fully opened.

Yet another feature of the present invention are cable management clips that are slidably movable along the first and second mounting portions of the base toward the first and second supports, respectively. The cable management clips are easily assembled to the wiring block and are used to more efficiently organize and manage the cables associated with the wiring block.

Another feature of the present invention is a hinged cable management block that may be used with the hinged wiring block. Both provide total access to the cabling channel and the cable management block is used to organize and tie down patch cords and jumpers.

Other features and advantages of the present invention will become apparent in the following description of the preferred embodiments, taken in conjunction with the accompanying drawings, which illustrate, by way of example, the principles of the invention.

DETAILED DESCRIPTION OF THE PREFERRED EMBODIMENTS

Figure 1:
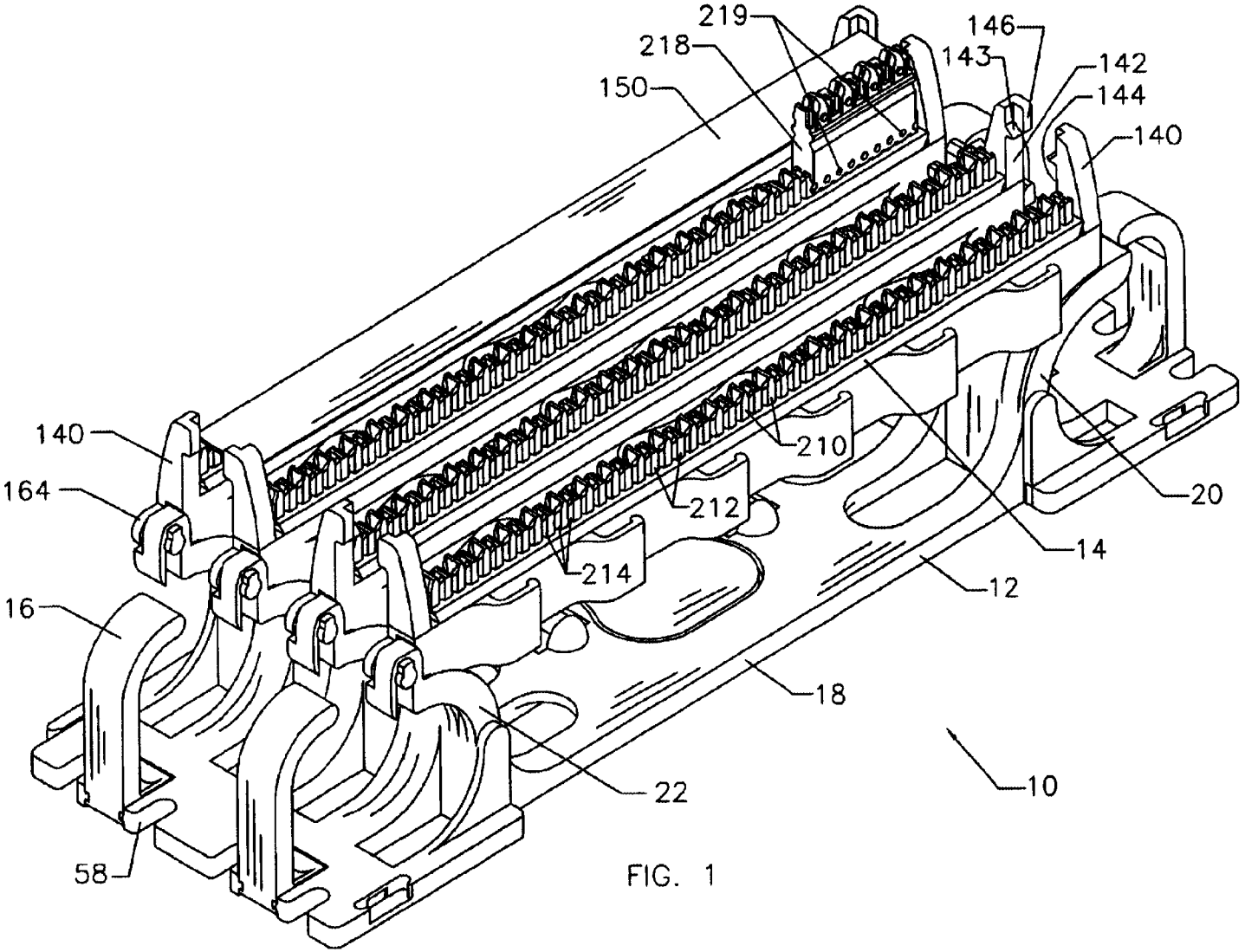
FIG. 1 is a perspective view of an assembled hinged wiring block according to the present invention with the hinged wiring block in a closed position.

A hinged wiring block 10 according to the present invention is shown in FIG. 1. The hinged wiring block 10 includes a base 12, a termination strip 14 and cable management clips 16.

Figure 2:
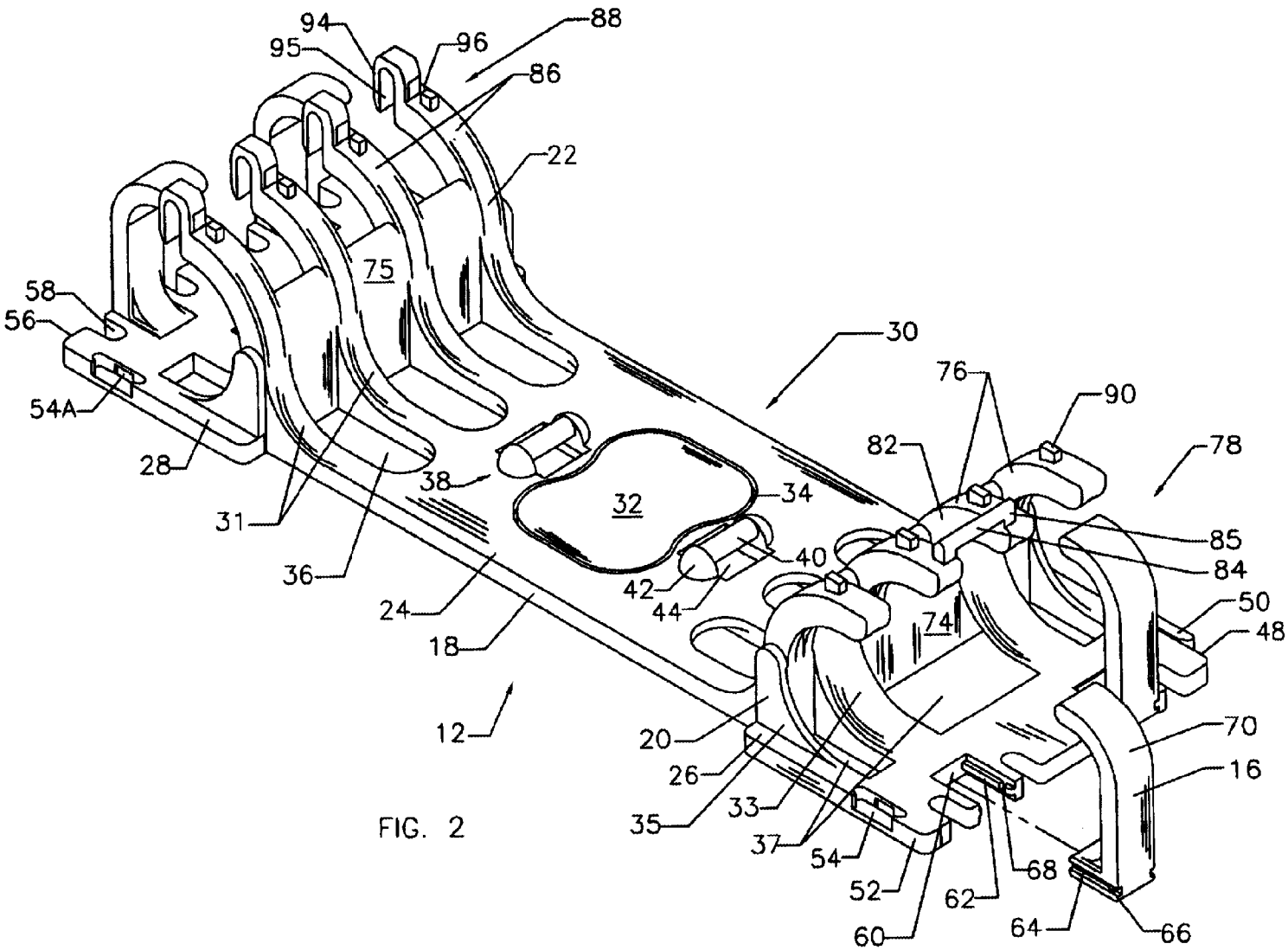
FIG. 2 is a perspective view of the base and the wire management clips of the wiring block of FIG. 1 with one of the wire management clips in an exploded position.

With reference to FIG. 2, the base 12 includes a base plate 18 and first and second spaced apart supports 20, 22 that extend outwardly from the base plate. Preferably, the base plate has a middle portion 24 and two end portions, a first mounting portion 26 and a second mounting portion 28. The middle portion is located between the first and second supports and together with the first and second supports forms a cabling channel 30 to receive cables having communication wires for terminating on the wiring block.

The middle portion 24 preferably includes several inner gussets 31 extending up from the base plate to strengthen the supports from inside the cabling channel. Each end portion 26, 28 of the base plate 18 includes outer gussets 33 extending up from the base plate to strengthen the supports from outside the cabling channel. Each end portion is preferably wider than the middle portion and includes two end gussets 35 extending up from the base plate to strengthen the supports from the side.

The middle portion 24 of the base plate includes a knockout panel 32 that is connected to the remainder of the base plate by thin tabs 34 that are spaced along the perimeter of the knockout panel. The knockout panel is removed by breaking the tabs, resulting in an access opening that allows insertion and routing of communication cables into the cabling channel.

Additional cable openings 36 are provided in the middle portion of the base plate adjacent each support 20, 22. Preferably, the openings are elongated and extend from between the gussets 31 toward the middle of the cabling channel. Cable openings 37 are also provided in the end portions adjacent to each support. Preferably, the cable openings 37 are elongated and extend from between the outer gussets 33, and from between the outer gussets 33 and the end gussets 35, away from the supports.

Cable tie blocks 38 are provided on either side of the knockout panel. Preferably, each cable tie block includes a short bar 40 spaced from the middle portion of the base plate by anchors 42 extending from the base plate. A small opening 44 may be provided adjacent the bar through the middle portion of the base plate to facilitate attachment of cables by cable ties (not shown).

Preferably, each end portion has a top side wall 48 defining an interlock tab 50 and a bottom side wall 52 defining an interlock groove 54. The tab and groove are used to align adjacent wiring blocks vertically and are especially helpful when a long series of blocks are placed together. Preferably, the tabs are thinner than the rest of the base plate and are easily snapped off if they are not needed. The tabs may also be provided with keys 50A (FIG. 3) that lock into keyways 54A of the slots.

Each end portion may also include an end wall 56 defining an open ended slot 58 for receiving a fastener (not shown) to mount the base plate to a support surface. The end walls also define rectangular shaped open-ended slots 60 for receiving the cable management clips 16 for organizing and managing the cables. Each rectangular shaped slot 60 has a side wall with a rail 62 along the length of the slot. Each cable management clip has a groove 64 along each side to engage a respective rail 62, permitting the clip to be slid into the rectangular shaped slot. A key 66 may be formed in the groove of the clip and a keyway 68 formed in the rail of the side wall to permit the clip to snap into place when properly mounted. Each cable management clip preferably has a curved upper end 70 to assist in holding communication cables between the clips 16 and the supports 20, 22. Although shown as a smooth curve, the curved upper ends 70 may also be made with several angled sections that bend toward the supports or a combination of straight and curved sections that bend toward the supports.

The first support 20 includes a solid wall portion 74 that extends outwardly from the base plate and a plurality of cable management fingers 76 that curve outwardly away from the cabling channel and preferably cooperate with the cable management clips 16 to form a cable management throughway 78 along the end portion 26 of the base plate. The cable management fingers are spaced apart above the wall portion 74 to permit the passage of communication cables from the cable management throughway 78 to the cabling channel 30.

Preferably, a pair of adjacent fingers are connected by a latch keeper 82 that is fixed to, and extends across the opening therebetween. The keeper includes a cross bar 84 mounted to a pair of adjacent fingers by supports 85.

The second support 22 also includes a solid wall portion 75 that extends outwardly from the base plate and a plurality of cable management fingers 86 that bend outwardly away from the cabling channel and preferably cooperate with the cable management clips 16 to form a cable management throughway 88 along the end portion 28 of the base plate. The cable management fingers are spaced apart above the wall portion 75 to permit the passage of communication cables from the cable management throughway 88 to cabling channel 30.

Figure 3:
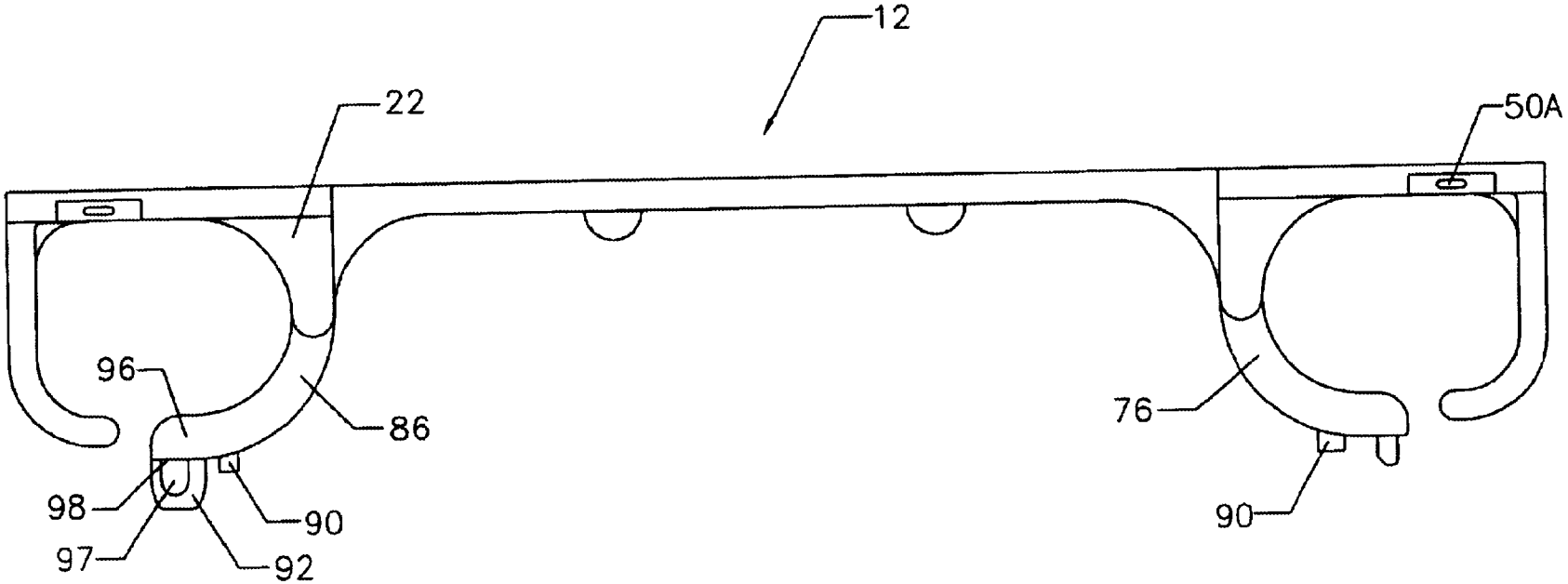
FIG. 3 is a top view of the base of the hinged wiring block of FIG. 1.

With reference also to FIG. 3, each cable management finger 86 of the second support 22 includes a bearing 92 at its free end. The bearing includes a U-shaped portion 94 having a slot 95 that opens toward the cable management throughway 88 (see FIG. 2). The bearing also includes a shoulder 96 that protrudes from the top of the U-shaped portion and extends across the open end of the U-shaped portion forming an access opening 97 into the slot 95. The shoulder also includes an outwardly facing bearing surface 98. The bearings are part of the hinge mechanism which will be described in more detail below.

Each cable management finger 76, 86 of each of the first and second supports may be provided with an outwardly directed alignment tab 90 near its end. As will be explained in more detail below, the alignment tabs provide for proper closure and locking of the hinged wiring block.

Figure 4:
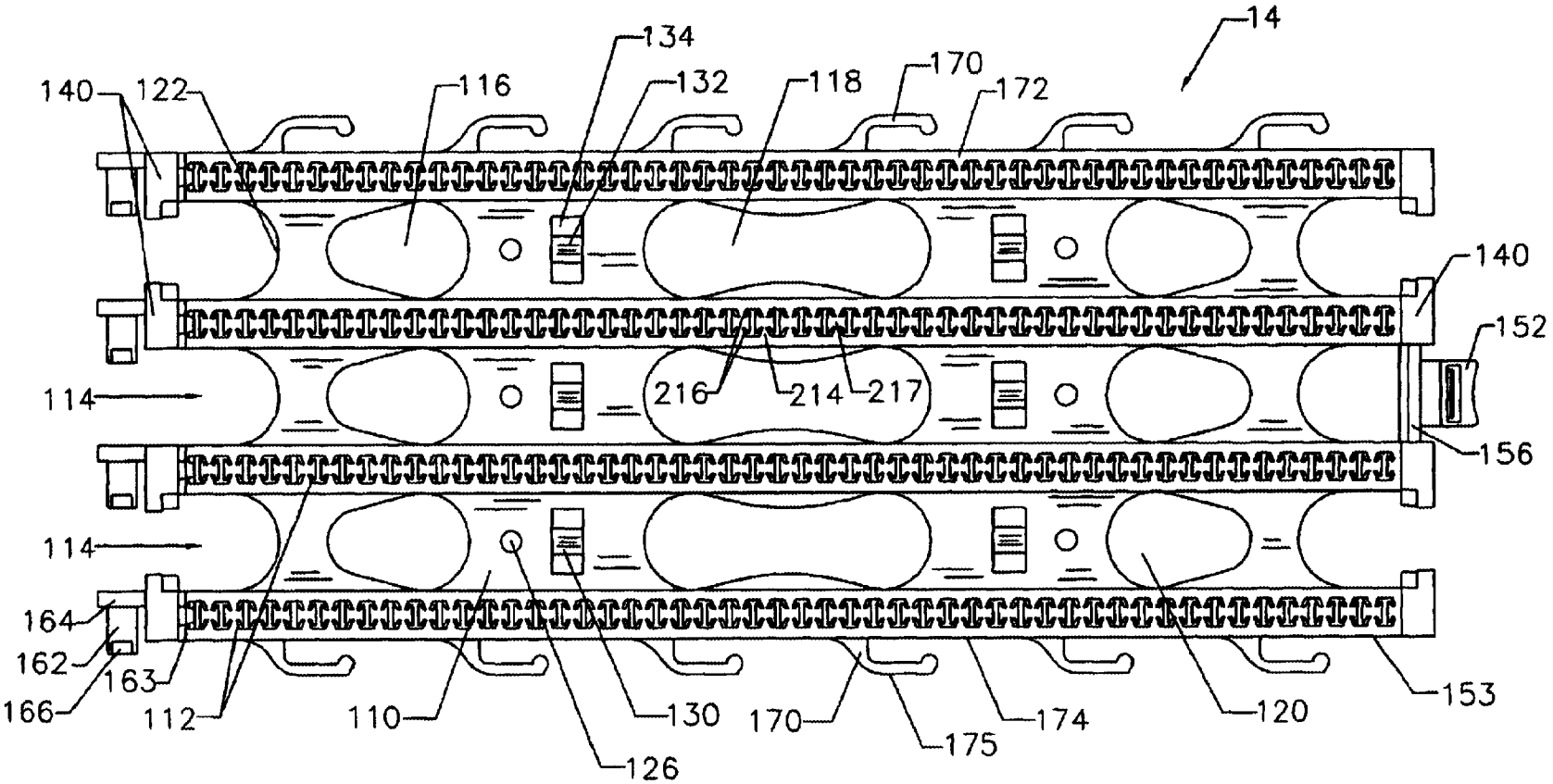
FIG. 4 is a front view of the termination strip of the wiring block of FIG. 1.
Figure 5:
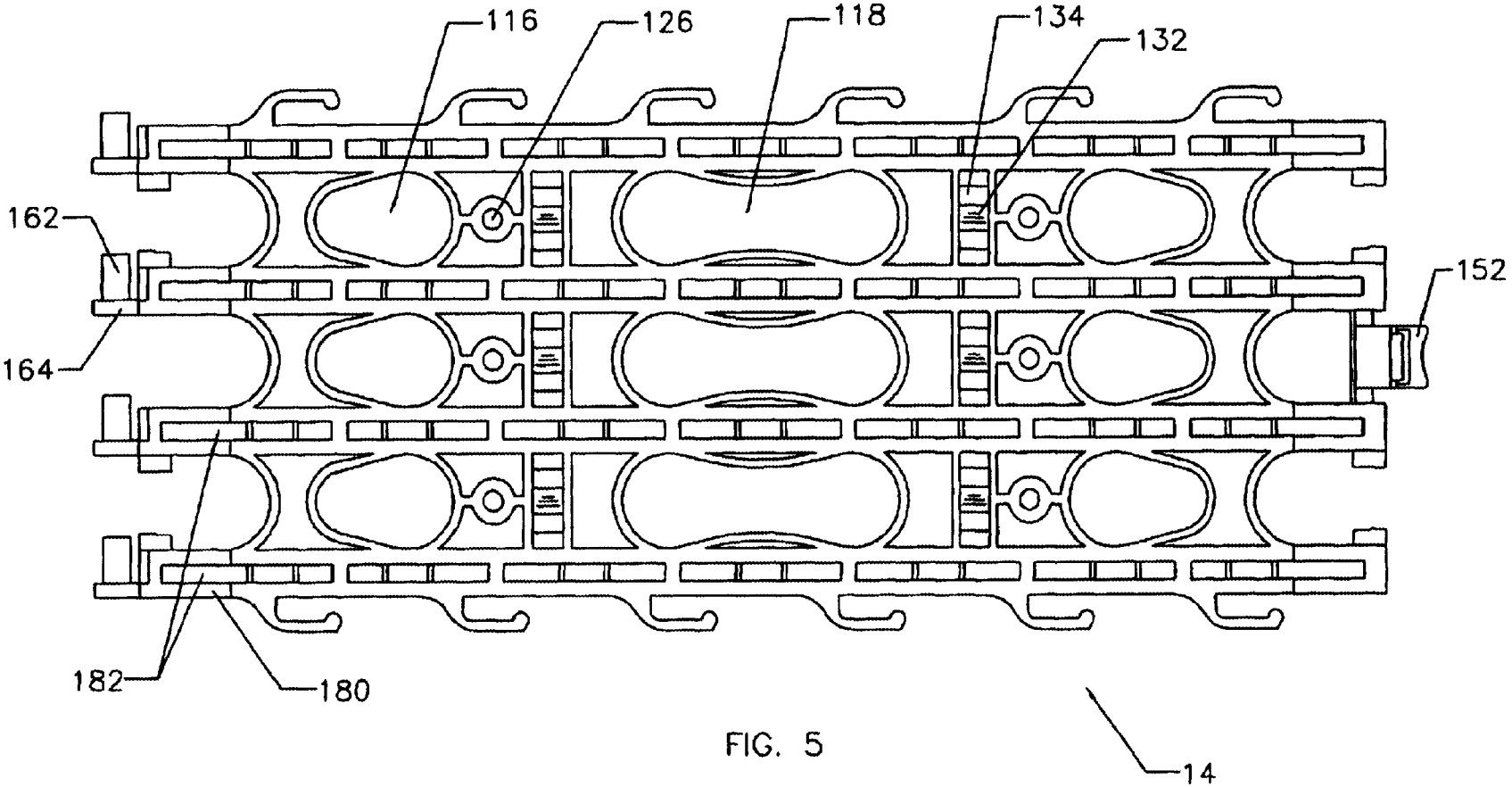
FIG. 5 is a rear view of the termination strip of the wiring block of FIG. 1.

With reference to FIGS. 4 and 5, the termination strip 14 includes a termination base 110 and several rows of spaced-apart wiring strips 112 running along the length of the termination base. The wiring strips may be detachably mounted to the termination base by methods well known in the art. See, e.g., U.S. Pat. No. Re. 35,030. An access channel 114 is defined between each pair of wiring strips.

The termination base 110 defines several large access openings 116 through the base to permit communication cables to travel from the cabling channel into the access channel and then to the wiring strips. The access openings may have any shape that permits several cables to pass through at the same time. The particular shape and quantity of the access openings are design features only. Preferably, between each pair of wiring strips is a race track shaped access opening 118 located at the middle of each respective access channel and two tear drop shaped access openings 120, one adjacent each end of each respective access channel.

The termination base also defines several arcuate shaped openings 122, one located at each end of each access channel. The arcuate shaped openings cooperate with the openings located between the cable management fingers 76, 86 of the first and second supports 20, 22 to permit the passage of communication cables from the cable management throughways 78, 88 to the cabling channel 30.

The termination base also includes one or more fastener openings 126 in each access channel to permit fastening of the termination strip directly to a support surface, if desired. In addition, the termination base is provided with one or more cable tie anchors 130 in each access channel. Each cable tie anchor includes an anchor bar 132 located in an opening 134 through the termination base. The cable tie anchor is used to secure a bundle of communication cables to the termination strip with a cable tie. Tying the cables to the termination strip allows for easier control and routing of the cables so that when the termination strip is rotated open, the cables move along with the termination strip, without causing stress or strain on the cables themselves, particularly when cables are fed from the cable management throughways 78,88 to the termination strip.

At each end of the termination base, in alignment with each wiring strip, is a clip arm 140 that extends outwardly from the termination base. For a wiring block having four wiring strips, there are preferably two pairs of clip arms at each end of the termination base. With reference also to FIG. 1, each clip arm has an inner surface 142 that faces an inner surface 144 of the adjacent clip arm with which it is paired. Each inner surface of the clip arm pair includes an end wall 146 that protrudes into the space between adjacent clip arms and an angled surface 148. The end walls and angled surfaces of each clip pair cooperate to retain a label holder 150 for the wiring block. The label holders may be appropriately marked to identify the wiring connections in any manner well known in the art.

Figure 6:
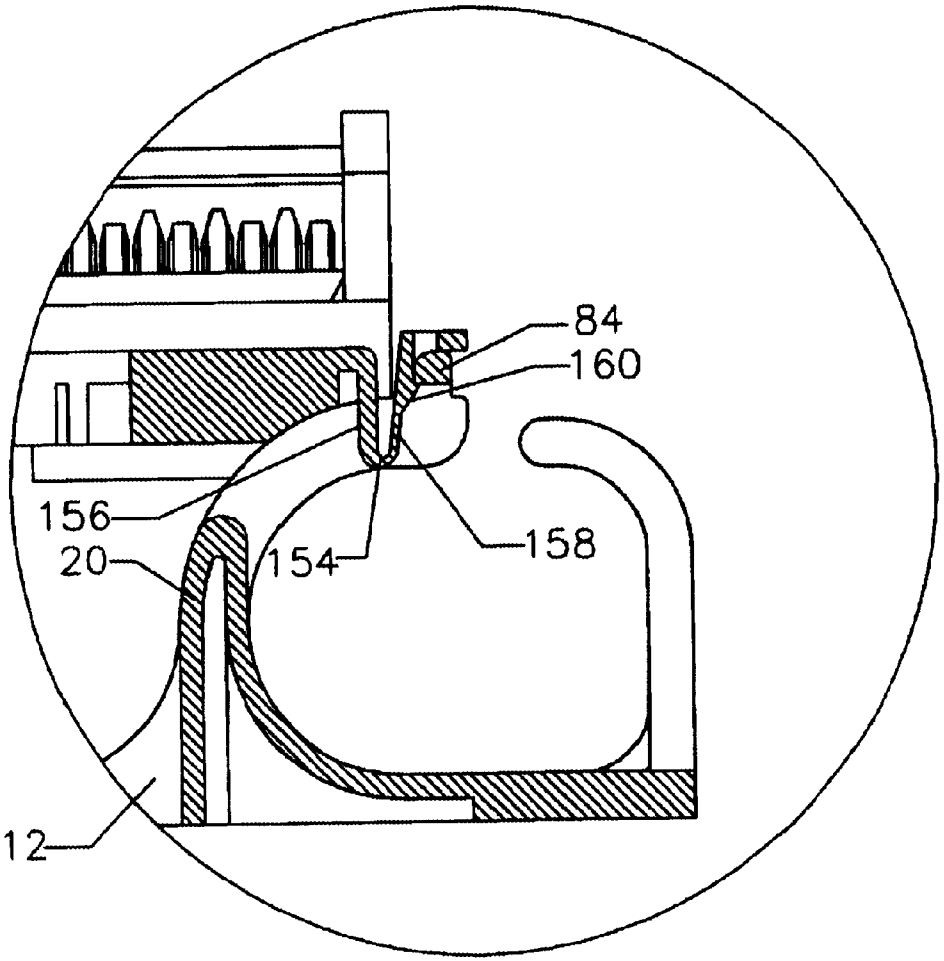
FIG. 6 is a sectional view of the latch mechanism.

The termination strip is also provided with a latch 152 at a first end 153 of the termination base. With reference also to FIG. 6, the latch preferably includes a U-shaped member 154 wherein a first side 156 of the member is fixed between two adjacent clip arms 140 and a second side 158 of the member is resiliently deflectable toward and away from the first side. The second side also includes a ramp 160 protruding from the second side and positioned to engage the cross bar 84 of the first support 20 of the base 12.

Pivot pins 162 are provided at a second end 163 of the termination base (FIGS. 4 and 5). The pivot pins are located adjacent each clip arm and extend transversely to the wiring strips. Extensions 164 of the termination base mount one end of the pivot pins to the termination base. The other ends of the pivot pins each have a latch bar 166 to facilitate securement of the termination strip to the base. The pivot pins also form a part of the hinge mechanism, which will be described in more detail below.

Cable clips 170 can be located along a top wall 172 and a bottom wall 174 of the termination strip to anchor down loose communication cables. Each cable clip preferably includes an extension that protrudes from the top or bottom wall and a portion 175 that extends in a direction parallel to the wiring strips. Preferably, each cable clip holds at least 4 pairs of communication wires to facilitate Category 5 installations.

With reference to FIG. 5, an inside surface 180 of the termination base includes a groove 182 adjacent to each clip arm. The grooves 182 cooperate with the alignment tabs 90 of the first and second supports 20, 22 to help the termination strip properly snap into place. The alignment tabs also stabilize the termination strip relative to the base.

With reference again to FIG. 1, each wiring strip 112 includes a plurality of spaced apart teeth 210, 212, which are separated by channels 214. The construction of such wiring strips are well known in the art. Briefly, the channels are defined by resilient side walls 216 which extend inwardly towards each other from both the front and back surfaces of the teeth (See FIG. 4). Preferably, the channels 214 are of an approximate size and shape to fixedly position an insulated wire (not shown) such that it extends across a rectangular opening 217 for electrical connection to a connector block 218 (See FIG. 1). The teeth alternate in height and include tapered sides to prevent incorrect location and to facilitate interconnection of the teeth with a row of beam contacts from the connector block 218. The wiring strip has a row of such rectangular openings 217 for accepting the beam contacts. To detachably interlock the connector block and the wiring strip, cylindrical protrusions (not shown) may be provided on each side of the teeth and corresponding openings 219 in the connector block 218 are provided.

Preferably, the base 12, the termination strip 14 and the cable management clips 16 are made of plastic, such as polycarbonate, or other material having high impact strength, chemical resistance and good dimensional stability. In the preferred embodiment, the base plate 18 and the first and second supports 20, 22 are a single integral piece.

Figures 7, 8:
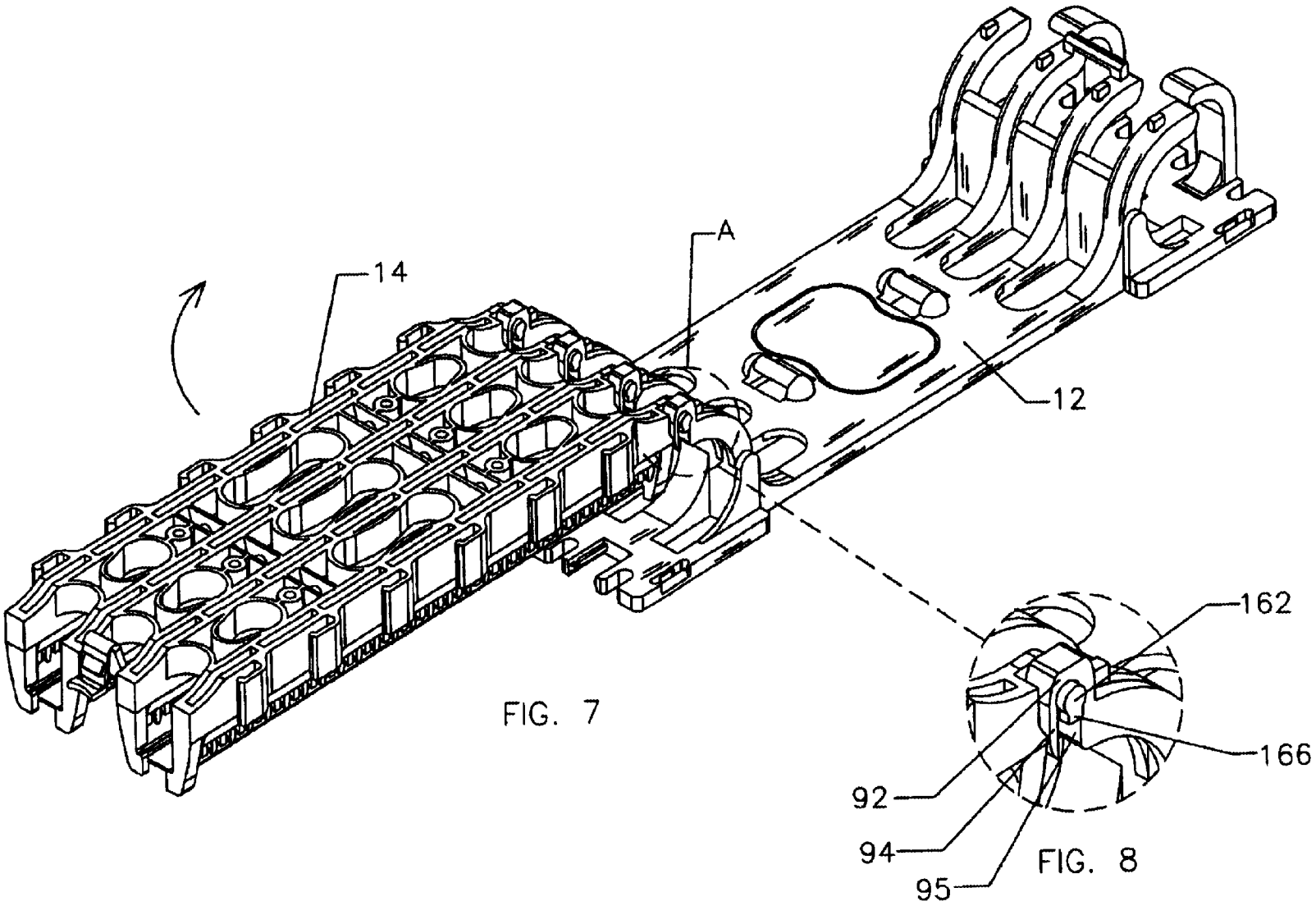
FIG. 7 is a perspective view of the assembled hinged wiring block of FIG. 1 with the termination strip in the fully opened position.
FIG. 8 is an enlarged view of the bearing/pivot pin connection shown in circle A in FIG. 7.

With reference to FIGS. 7 and 8, the base 12 and the termination strip 14 are assembled by aligning the pivot pins 162 with the bearings 92 and sliding the pivot pins into the bearings from the side opposite the U-shaped slots 95. The access openings 97 (see FIG. 3) have a sufficient size to receive the pivot pins, including the latch bars 166. The pivot pins are slid into the bearings until the latch bars 166 clear the U-shaped portions 94. Once assembled, the pivot pins and bearings form a hinge about which the termination strip may be pivoted.

Figures 9, 10:
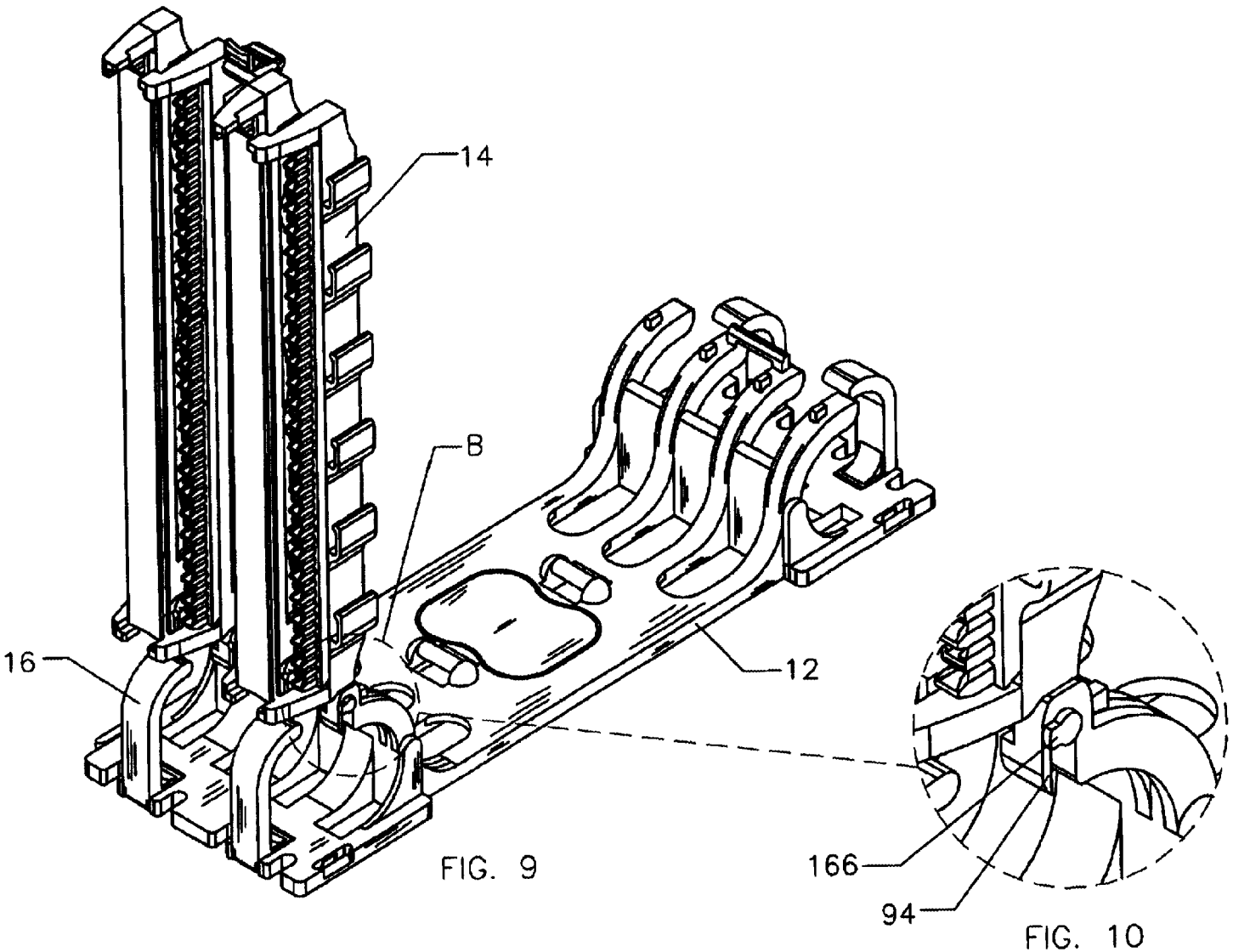
FIG. 9 is a perspective view of the assembled hinged wiring block of FIG. 1 with the termination strip in an intermediate position.
FIG. 10 is an enlarged view of the bearing/pivot pin connection shown in circle B in FIG. 9.

With reference to FIGS. 9 and 10, when the termination strip is pivoted from the fully open position to an intermediate position, the latch bars 166 will rotate into a blocking position relative to the U-shaped portions 94 to prevent the pivot pins from sliding out of their bearings. At this time, the cable management clips 16 may be inserted into the base. In the preferred embodiment, the clips 16 prevent the termination strip from returning to the fully open position and disassembly of the termination strip from the base is thereby prevented.

Figure 11:
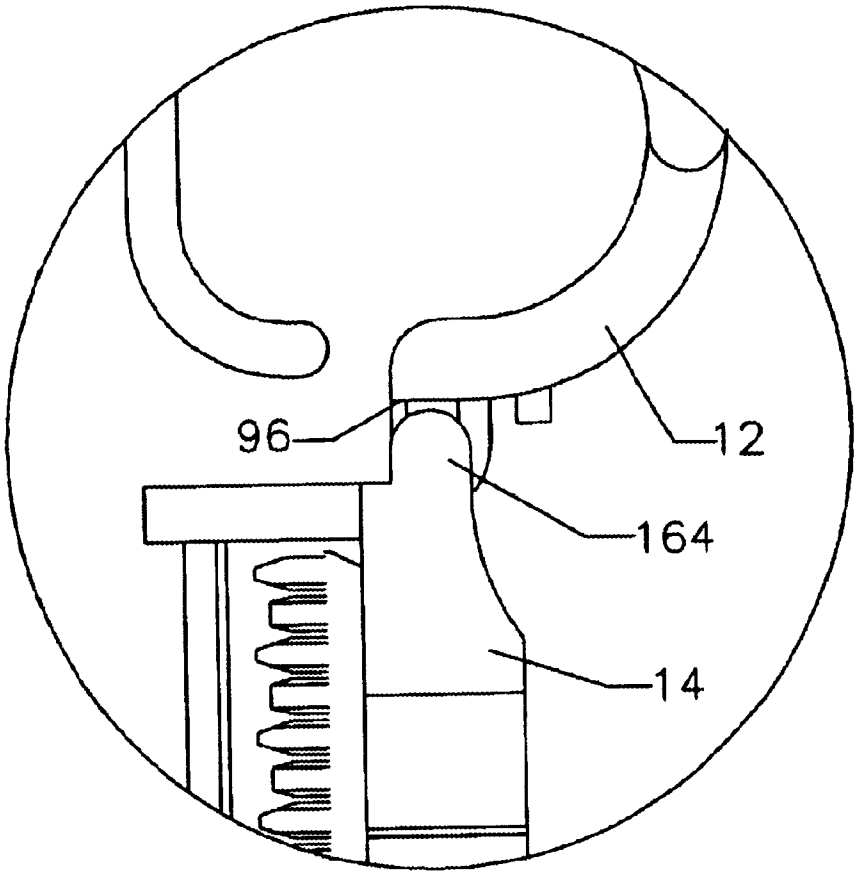
FIG. 11 is a top view of the hinge connection.

With reference to FIGS. 1 and 11, the extensions 164 connecting the pivot pins to the termination strip may be appropriately contoured to provide a sliding contact with the bearing surfaces 96 through the full range of motion of the termination strip relative to the base.

Figure 12:
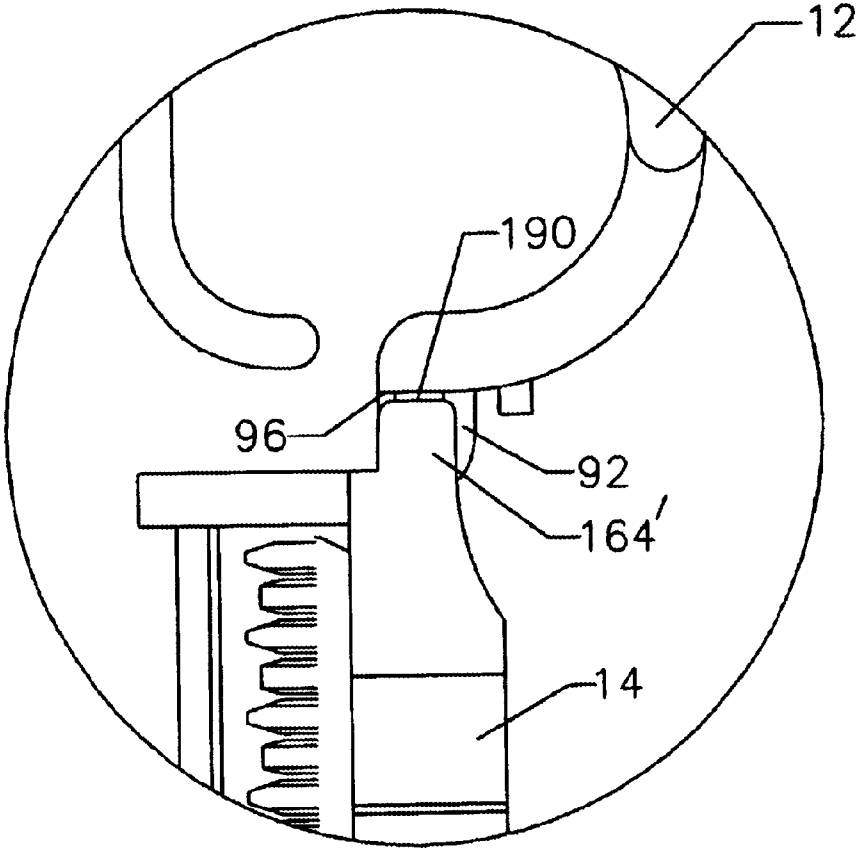
FIG. 12 is a top view of an alternative hinge connection with stop.

With reference to FIG. 12, the extensions 164' have been modified to permit the wiring strip to be stopped and held at a desired location as it is pivoted from the fully closed position to the fully opened position. In the preferred embodiment, each extension 164' has a flat end 190 that rests against the bearing 92 of the base adjacent the shoulder 96 to temporarily hold the termination strip 14 in the intermediate position.

Preferably, the stop position of the T-strip is at 90° relative to the closed position, but other stop positions may be used or several stop positions may be used on one termination strip. Other mechanisms for providing a stop position will be readily apparent to those skilled in the art. For example, the pivot pins 162 of the termination strip may be shaped (e.g., an oval shape) to bear against the inside surface of the access opening 97 of the base to hold the termination strip in the preferred position.

After the hinged wiring block has been assembled, the termination strip may be pivoted into the closed position wherein the latch ramp 160 engages the cross bar 84 of the latch keeper, deflecting the U-shaped member until the ramp clears and locks against the cross bar (see FIG. 6). In addition, the alignment tabs of the supports enter the grooves on the inside surface of the termination strip to insure that the wiring block is properly closed.

The wiring block is installed by mounting it to an appropriate mounting surface. Fasteners, such as mounting screws, are inserted into the open ended slots 58 of the base to mount the base to the support surface (FIGS. 1 and 2). Once the wiring block is mounted, the latch is compressed to open the wiring block, exposing the cabling channel 30 between the first and second supports of the base. Communication cables may then be routed within the base using cable ties and the cable tie blocks 38 to secure the communication cables. Alternatively, or in addition, communication cables may be also routed through the cable management throughways 78, 88 along the end portions 26, 28 of the base. Subsequently, the communication cables are fed through the proper access openings 116 (FIG. 4) in the termination strip. Cable ties may also be used with the cable tie anchors 130 to secure the communication cables to the termination strip.

After the communication cables have been fed through the access openings, the cable sheathes may be stripped back as much as necessary to expose the communication wires for termination. The communication wires are then positioned in the appropriate channel 214 of the wiring strip and trimmed with a punch down tool by methods well known in the art (FIG. 1). Connector blocks 218 are then aligned in the proper channels of the wiring block and a punch down tool is used to seat the connector block. Finally, the cabling drop is labeled using label holders 150 which are snapped into place against the end walls 146 and the angled surfaces 148 of adjacent clip arms 140.

Figure 13:
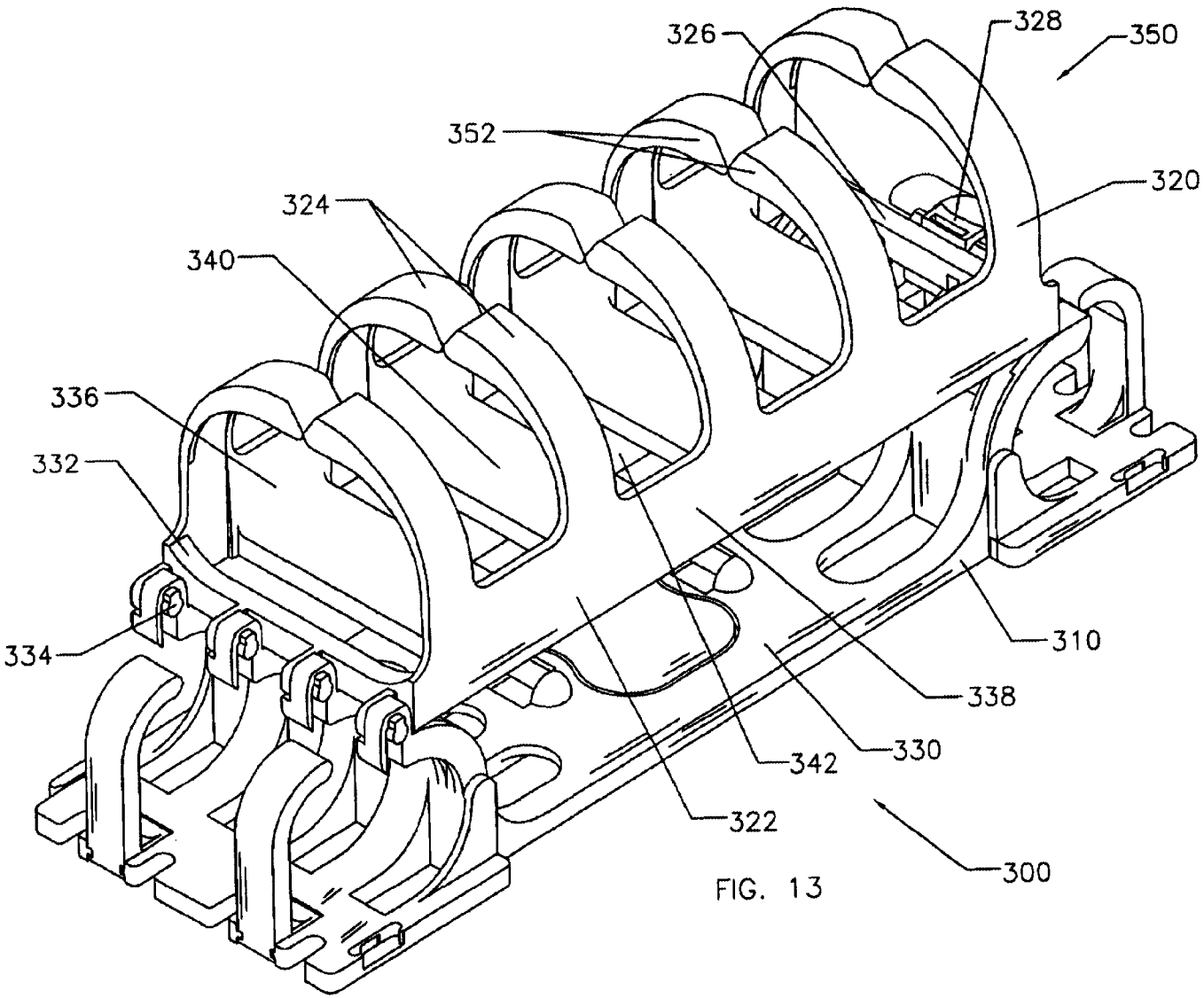
FIG. 13 is a perspective view of an assembled hinged cable management block according to the present invention.

With reference to FIG. 13, a cable management block 300 includes a base 310, a cable management strip 320 and a cabling channel 330 between the base and the cable management strip. The base is essentially the same as the base 12 used with the wiring block 10 (see FIG. 1). The cable management strip includes a clip base 322 and several pairs of opposed cable management fingers 324 extending outwardly from the clip base.

The cable management strip 320 includes a first end wall 326 having a latch 328 which is essentially the same as the latch 152 of the termination strip 14 (see FIG. 4) and which is also used to connect the cable management strip to the clip base.

The cable management strip also includes a second end wall 332 that supports pivot pins 334 which are essentially the same as the pivot pins 162 of the termination strip 14 and which are also used to provide a hinge connection with the base 310 of the cable management block. The hinged connection between the base 310 and the cable management strip 320 operates in essentially the same manner as in the wiring block and therefore does not need to be described in further detail.

Preferably, the clip base 322 has a top wall 336, a bottom wall 338 and a slotted wall 340 extending between the top and bottom walls. The slotted wall defines several openings 342 for passage to and from the cabling channel 330. In the preferred embodiment, the pairs of opposed cable management fingers are located directly above the openings of the slotted wall. The cable management fingers and the slotted wall define a cable management passageway 350 for holding several cables or bundles of cables. Preferably, the cable management fingers of each pair have ends 352 that contact each other or are close enough together to prevent a cable from inadvertently coming out of the cable management passageway. The cable management fingers, however, are sufficiently flexible and resilient to permit insertion and removal of cables or bundles of cables from the cable management passageway.

From the foregoing, it will be appreciated that the hinged wiring block of the present invention provides a unique swing-out design that enables a user to position and install the wiring block first and then do the cable routing afterwards. The hinged design also provides total access to the cabling channel during installation of the communication cables and termination of the communication wires, making installation and termination easier and more efficient.

While a particular form of the invention has been illustrated and described, it will be apparent that various modifications can be made without departing from the spirit and scope of the invention. Accordingly, it is not intended that the invention be limited, except by the appended claims.

What is claimed is:

1. A wiring block mountable to a support surface for terminating communication wires, comprising:

a base having a first support member and a second support member, the first and second support members being spaced apart to form a cabling channel therebetween for receiving communication wires; and a termination strip having a row of spaced-apart teeth extending from a location adjacent a first end portion of the termination strip to a location adjacent a second end portion of the termination strip, the spaced-apart teeth defining a plurality of slots, each of the plurality of slots for receiving a respective one of the communication wires;

wherein the first end portion of the termination strip is removably attachable to the first support member and the second end portion of the termination strip is hingedly connected to the second support member such that the termination strip is movable between a closed position wherein the first end portion of the termination strip is attached to the first support member closing off the cabling channel and an open position wherein the first end portion of the termination strip is detached and pivoted away from the first support member to form an opening therebetween to permit insertion and removal of communication wires through the opening between the first end portion of the termination strip and the first support member into and out of the cabling channel, wherein the second end portion of the termination strip is hingedly connected to the second support member about a hinge axis that is perpendicular to the row of spaced apart teeth.

2. The wiring block of claim 1, wherein the base includes a baseplate extending from the first support member to the second support member, the baseplate being spaced from the termination strip when the termination strip is in the closed position.

3. The wiring block of claim 2, wherein the baseplate defines an access opening into the cabling channel for cables of communication wires.

4. The wiring block of claim 2, wherein the baseplate includes a knockout panel between the first and second support members.

5. The wiring block of claim 2, wherein the baseplate includes a cable tie means for securing cables of communication wires to the baseplate between the first and second support members.

6. The wiring block of claim 1, wherein the termination strip is pivotable between the closed position and a fully open position and further comprising a stop that holds the termination strip in an intermediate position between the closed position and the fully open position.

7. The wiring block of claim 6, wherein the fully open position of the termination strip is about 180 degrees from the closed position and the intermediate position of the termination strip is about 90 degrees from the closed position.

8. The wiring block of claim 1, further comprising:

a cable management base having a first support member and a second support member, the first and second support members of the cable management base being spaced apart to form a cabling channel therebetween for receiving communication wires;

a cable management strip having a laterally extending clip base and a plurality of laterally spaced pairs of opposed cable management fingers extending from the clip base to form a cabling passage between the plurality of pairs and the clip base;

wherein the cable management strip has a first end that is removably attachable to the first support member and a second end that is hingedly connected to the second support member such that the cable management strip is movable between a closed position wherein the first end of the cable management strip is attached to the first support member closing off the cabling channel and an open position wherein the first end of the cable management strip is detached and pivoted away from the first support member to form an opening therebetween to permit insertion and removal of communication wires through the opening between the first end of the cable management strip and the first support member into and out of the cabling channel; and wherein the wiring block base and the cable management base are located adjacent to each other with their respective cabling channels aligned with each other.

9. A wiring block mountable to a support surface for terminating communication wires, comprising:

a base having a first support member and a second support member, the first and second support members being spaced apart to form a cabling channel therebetween for receiving communication wires;

a termination strip mounted to the first and second support members having a row of spaced-apart teeth defining a plurality of slots, each of the plurality of slots for receiving a respective one of the communication wires; and wherein the first mounting portion has a first wall with a tab extending away from the first wall and a second wall opposite the first wall defining a groove having the same shape as the tab such that adjacent wiring blocks may be interlocked to one another with their cabling channels aligned, with the tab of one wiring block located in the groove of an adjacent wiring block.

10. A cable management block mountable to a support surface for managing communication cables comprising:

a cable management base having a first support member and a second support member, the first and second support members of the cable management base being spaced apart to form a cabling channel therebetween for receiving communication wires;

a cable management strip having a laterally extending clip base and at least three laterally spaced pairs of opposed cable management fingers extending from the clip base to form a cabling passage between the plurality of pairs and the clip base;

wherein the clip base has a first end that is removably attachable to the first support member and a second end that is hingedly connected to the second support member such that the cable management strip is movable between a closed position wherein the first end of the clip base is attached to the first support member closing off the cabling channel and an open position wherein the first end of the clip base is detached and pivoted away from the first support member to form an opening therebetween to permit insertion and removal of communication wires through the opening between the first end of the clip base and the first support member into and out of the cabling channel;

wherein the second end portion of the cable management strip is hingedly connected to the second support member about a hinge axis that is perpendicular to the cabling passage.

* * * * *